US010589136B2

(12) United States Patent
Samaniego

(10) Patent No.: US 10,589,136 B2
(45) Date of Patent: Mar. 17, 2020

(54) DISPOSABLE PROTECTIVE GARMENT

(71) Applicant: DUPONT SAFETY & CONSTRUCTION, INC., Wilmington, DE (US)

(72) Inventor: Muriel Samaniego, Oberkochen (DE)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 343 days.

(21) Appl. No.: 15/011,992

(22) Filed: Feb. 1, 2016

(65) Prior Publication Data

US 2016/0220852 A1 Aug. 4, 2016

Related U.S. Application Data

(60) Provisional application No. 62/111,778, filed on Feb. 4, 2015.

(51) Int. Cl.
*A62B 17/00* (2006.01)
*A41D 27/00* (2006.01)
(Continued)

(52) U.S. Cl.
CPC ..... *A62B 17/006* (2013.01); *A41D 13/00* (2013.01); *A41D 13/12* (2013.01); *A41D 27/00* (2013.01); *A41D 27/245* (2013.01); *A41D 2400/44* (2013.01); *A41D 2400/52* (2013.01); *A41D 2400/70* (2013.01)

(58) Field of Classification Search
CPC .. A41D 13/00; A41D 13/1245; A41D 27/245; A41D 27/00; A41D 2400/70; A41D 2400/44; A41D 2400/52; A41D 13/12; A41D 13/1236; A41D 2400/72; A41D 2300/328; A41D 2300/52; A41D 2300/33; A61F 13/085; A62B 17/006;
(Continued)

(56) References Cited

U.S. PATENT DOCUMENTS 3,470,568 A * 10/1969 Belkin ..... A41D 13/1209 2/114
4,117,609 A 10/1978 Helt
(Continued)

OTHER PUBLICATIONS

International Search Report, dated Apr. 21, 2016, for corresponding International Application No. PCT/US2016/015936, filing date Apr. 21, 2016.

*Primary Examiner* — Nathan E Durham
*Assistant Examiner* — Abby M Spatz

(57) ABSTRACT

This invention concerns a disposable protective garment comprising a protective fabric, the garment being provided with at least one continuous line of flexible sealing material extending from the neck opening to at least one other opening in the garment, the continuous line of sealing material forming a liquid-impervious seal between the first and second parts of protective fabric in the garment; wherein the sealing material has a tensile strength less than the tensile strength of the protective fabric and the continuous line of flexible sealing material can be torn open by the wearer for doffing of the garment. This invention also concerns a disposable protective garment wherein the at least one continuous line of flexible sealing material extends from a torso opening to at least one pants sleeve opening.

4 Claims, 4 Drawing Sheets

(51) Int. Cl.
*A41D 13/00* (2006.01)
*A41D 27/24* (2006.01)
*A41D 13/12* (2006.01)

(58) Field of Classification Search
CPC ..... B65D 75/5827; B65D 75/708; A41F 1/00; Y10T 428/15
USPC ..... 2/457, 46, 114, 2.17, 913, 912, 275, 69, 2/456, 51, 96, 85, 271; 128/849, 874, 128/853
See application file for complete search history.

(56) References Cited

U.S. PATENT DOCUMENTS

| | | | | |
|---|---|---|---|---|
| 4,214,321 | A | 7/1980 | Nuwayser | |
| 4,272,851 | A | 6/1981 | Goldstein | |
| 4,772,510 | A | 9/1988 | McClure | |
| 4,833,010 | A | 5/1989 | Langley | |
| 4,855,178 | A | 8/1989 | Langley | |
| 4,920,575 | A | 5/1990 | Bartasis et al. | |
| 5,035,941 | A | 7/1991 | Blackburn | |
| 5,162,148 | A | 11/1992 | Boyle et al. | |
| 5,586,339 | A | 12/1996 | Lathan | |
| 5,603,123 | A * | 2/1997 | Chupa | A41D 13/1236 2/114 |
| 5,626,947 | A | 5/1997 | Hauer et al. | |
| 2009/0126088 | A1 | 5/2009 | Yadav et al. | |
| 2011/0016606 | A1* | 1/2011 | Bothwell | A41D 13/1245 2/114 |
| 2012/0312308 | A1 | 12/2012 | Allen | |
| 2013/0318682 | A1* | 12/2013 | Graneto, III | A41D 13/1236 2/114 |

* cited by examiner

DISPOSABLE PROTECTIVE GARMENT

BACKGROUND OF THE INVENTION

This invention relates to a disposable protective garment for use in hazardous environments having features that are believed to reduce the potential the wearer will be exposed to contamination. While it is believed to be particularly useful in protective garments for use with biohazards, it can find use in any chemical or other apparel used to cover and/or protect workers.

U.S. Pat. No. 5,586,339 to Latham discloses a disposable, thin, polyethylene, heat-joined garment comprising a torso covering assembly and a pants assembly. This patent further discloses a rip cord for tearing apart the torso covering assembly and the pants assembly.

U.S. Pat. No. 4,117,609 to Helt discloses a rip cord safety device for waders for opening the wader boots from toe to top with single upward puling motion.

Recent biohazard outbreaks like the Ebola crisis have highlighted the dangers medical workers experience when treating Ebola patients. Any improvement in protective garments that is believed to enhance the safety of these workers is desired. Garment features that reduce the risk of mistakes while putting on the apparel (donning) and removing the apparel (doffing) are desired. Particularly desirable is a clothing system that is already safely closed by the manufacturer so there is no risk of donning mistakes (such as incomplete sealing of openings) and also reduces the risk of contamination during use because there is limited potential risk to be contaminated through an existing closure like a zipper or a flap. Further, any improvement that helps the worker remove or doff a contaminated garment without undue exposure is also desired.

BRIEF SUMMARY OF THE INVENTION

This invention relates to a disposable protective garment comprising a protective fabric, the garment having a body portion for covering at least a portion of a person's torso when the garment is worn by a person; the body portion having at least one torso opening for donning the garment and an neck opening for a person's head and neck; the body portion further having a plurality of openings; the plurality including at least a first opening ending in a first sleeve for receiving a portion of a person's right arm when the person wears the garment, and a second opening ending in a second sleeve for receiving a portion of a person's left arm when the person wears the garment, each of the sleeves further having an opening for a person's wrist and hand; the garment having an interior surface facing a person's body when the person wears the garment and an exterior surface facing a potentially hazardous environment or threat; the garment being provided with at least one continuous line of flexible sealing material extending from the neck opening to at least one other opening in the garment, the sealing material attaching a first part of the protective fabric to a second part of the protective fabric, the continuous line of sealing material forming a liquid-impervious seal between the first and second parts of protective fabric; wherein the sealing material has a tensile strength less than the tensile strength of the protective fabric and the continuous line of flexible sealing material can be torn open by the wearer for doffing of the garment.

In some embodiments, the protective garment further comprises a set of neck opening tear tabs for initiating the tear of the continuous line of flexible sealing material, and in some embodiments, the protective garment further comprises a set of interior tear tabs for assisting and continuing the tear of the continuous line of flexible sealing material.

In another embodiment, this invention relates to a disposable protective garment comprising a protective fabric, the garment having a body portion for covering at least a portion of a person's torso when the garment is worn by a person; the body portion having at least one torso opening for donning the garment and a plurality of openings; the plurality including at least a first opening ending in a first pants sleeve for receiving a portion of a person's right leg when the person wears the garment, and a second opening ending in a second pants sleeve for receiving a portion of a person's left leg when the person wears the garment, each of the pants sleeves further having an opening for a person's ankle and foot; the garment having an interior surface facing a person's body when the person wears the garment and an exterior surface facing a potentially hazardous environment or threat; the garment being provided with at least one continuous line of flexible sealing material extending from the torso opening to at least one pants sleeve opening, the sealing material attaching a first part of the protective fabric to a second part of the protective fabric, the continuous line of sealing material forming a liquid-impervious seal between the first and second parts of protective fabric; wherein the sealing material has a tensile strength less than the tensile strength of the protective fabric and the continuous line of flexible sealing material can be torn open by the wearer for doffing of the garment.

DETAILED DESCRIPTION OF THE INVENTION

Figure 1:
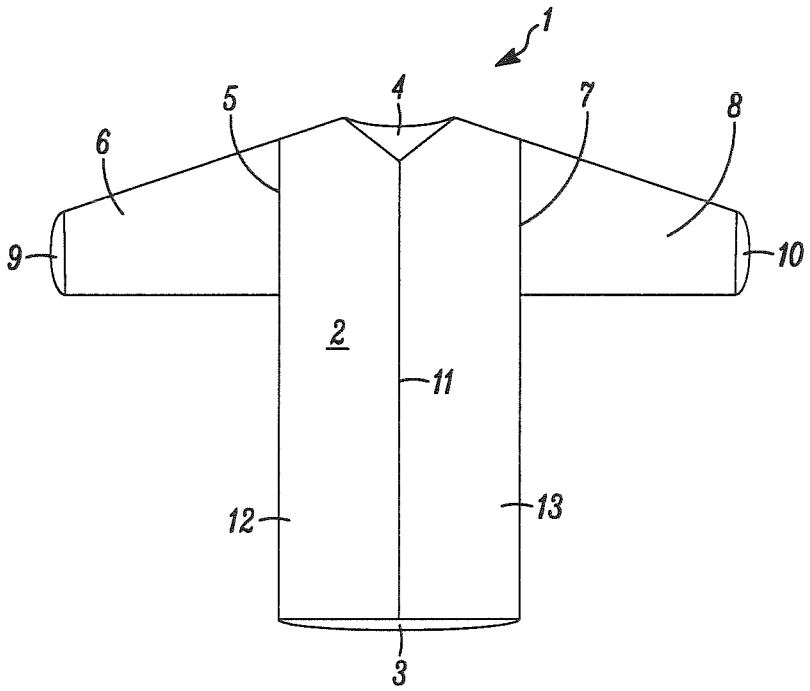
FIGS. 1 & 2 are illustrations of a disposable protective garment with the continuous line of sealing material shown centered vertically on the front of the garment and several alternative positions of the continuous line of sealing material on the front of the garment.

This invention relates to a disposable protective garment having features that are believed to reduce the potential the wearer will be exposed to contamination. These features can be explained, without limitation, by referring to the drawings.

FIG. 1 is an illustration of one possible disposable protective garment 1 comprising a protective fabric as the exterior surface of the garment and preferably having a fabric liner on the interior of the garment. The garment includes a body portion 2 for covering at least a portion of a person's torso having at least one torso opening 3 for donning the garment and a neck opening 4 for a person's head and neck. The body portion further comprises a plurality of openings, including a first opening 5 ending in a first sleeve 6 for receiving a portion of a person's right arm when the person wears the garment, and a second opening 7 ending in a second sleeve 8 for receiving a portion of a person's left arm when the person wears the garment. Each of the ends of the first and second sleeves have openings 9 & 10 for a person's wrists and hands. If desired the sleeves can be provided with cinching tapes, such as hook and loop fasteners, for closing the sleeves around the wrists of the wearer (not shown). Likewise, string ties or other closure options for any of the openings can be employed if desired.

The garment 1 has an interior surface defined as the surface facing a person's body when the person wears the garment; that is, any surface of the garment that is closest to the wearer when the garment is worn, generally considered the inner surface of the garment. The exterior surface of the garment is defined as the surface facing a potentially hazardous environment or threat; that is generally considered the outer surface of the garment.

The garment is provided with at least one continuous line of flexible sealing material 11 extending from the neck opening 4 to at least one other opening in the garment. In FIG. 1, the one continuous line of flexible sealing material is shown as a solid line and is shown in one preferred arrangement wherein it extends from the neck opening 4 to the torso opening 3.

The sealing material attaches a first part 12 of the protective fabric to a second part 13 of the protective fabric as shown in FIG. 1. For the purposes herein, "a first part" and "a second part" generally refer to a first end of fabric and a second end of fabric that are to be joined, even if the two ends are opposing edges of a single piece of fabric. For example, first part 12 and second part 13 can be opposing edges of a continuous piece of protective apparel fabric that is cut such that there is no seam in the back of the garment; the two "parts" do not have to be separate pieces of fabric.

The continuous line 11 of sealing material is a liquid-impervious seal between the first and second parts of protective fabric. Further, the sealing material has a tensile strength less than the tensile strength of the protective fabric. This allows the continuous line of flexible sealing material to be torn open by the wearer for doffing of the garment. The mechanical strength of the sealing material and the protective fabrics (the break tensile strength) can be determined in accordance with ASTM D-5034-95 "Standard Test Method for Breaking Strength and Elongation of Fabrics (Grab Test)".

Figure 2:
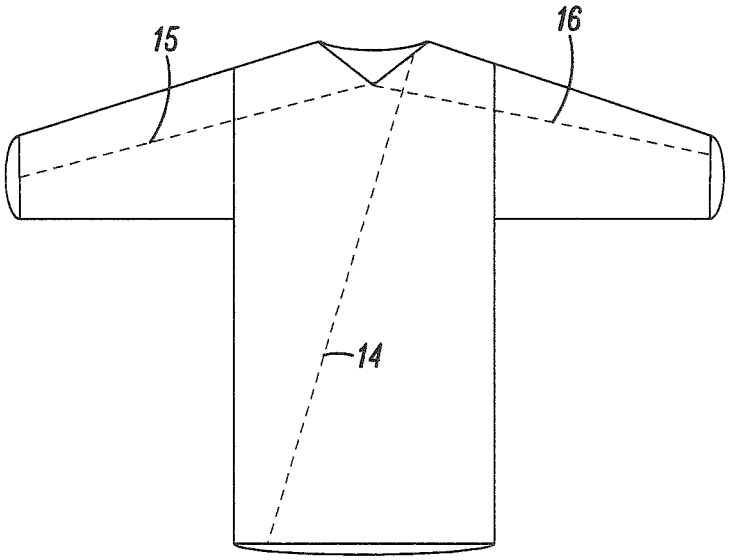

Alternatively FIG. 2. illustrates some other possible locations for the continuous line of flexible sealing material. For example, the continuous line of flexible sealing material can be positioned on angle from the neck opening to the torso opening as shown by dotted line 14, Also shown in this figure is the continuous line of flexible sealing material positioned to extend from the neck opening to a sleeve opening as shown by dotted line 15. If desired multiple continuous line of flexible sealing material can be used in the garment, for example, both sleeves can incorporate the continuous line of flexible sealing material as shown by dotted lines 15 & 16.

Figure 3:
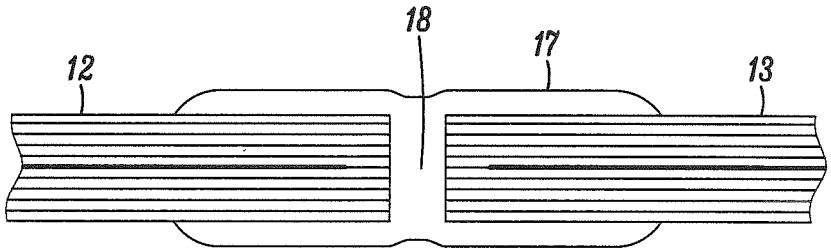
FIGS. 3 & 4 are cross-sections of one possible representation of the continuous line of sealing material attaching first and second parts of a protective fabric, and one possible representation of the addition of tape of a protective fabric covering the continuous line of flexible sealing material.

FIG. 3, is a cross-sectional detail of one possible representation of the continuous line of sealing material attaching first (12) and second (13) parts of a protective fabric. In this representation, the continuous line of sealing material 17 is shown as essentially a melted resin on the surfaces of the first and second parts and on both sides and in the joint 18 between the parts that consists only of the sealing material. In some embodiments this joint between the edges of the first and second parts has a gap length of 0.5 to 3 mm, preferably 1 to 1.5 mm. First (12) and second (13) parts of protective fabric are preferably shown folded, with the fold forming the edge of each part. Since most protective fabrics are laminates or composite structures of several layers wherein one surface of the fabric is different from the other, this allows the use of a single sealing material that is compatible with the outer surface of the protective fabric to be used.

This detail can be accomplished by the use of seam sealing tape generally applied to both sides of the joint and a seam sealing machine, which is then "seals" the two parts or edges together using heat and pressure to melt and adhere the tape. While this particular detail is preferred, obviously an alternative joint wherein the edges of the parts are overlapped and then sealed together, with the seam tape positioned between the overlapped edges, would work in a similar manner and be suitable as a continuous line of sealing material. Likewise, it is believed another suitable continuous line of sealing material would result if the two edges are fully abutted and the seam tape applied to both outer surfaces without an appreciable amount in the actual joint between the edges.

Suitable seam tapes create a liquid impervious seal and have either the same chemical barrier performance as the protective fabric, or at least barrier performance suitable for use with the expected environmental hazard. However, the seam tape does not have the same mechanical performance as the protective fabric. In a preferred embodiment, the sealing material provides flexible continuous line of sealing that once cut, rips straight and easily, but if not cut or notched will not or is not easily torn. Therefore in a preferred embodiment the disposable protective garment further comprises a small starting cut or notch in the continuous line of flexible sealing material. Suitable seam tape machine systems include those available from Queen Light Electronic Industries, Ltd. of Wakwayama, Japan.

Figure 4:
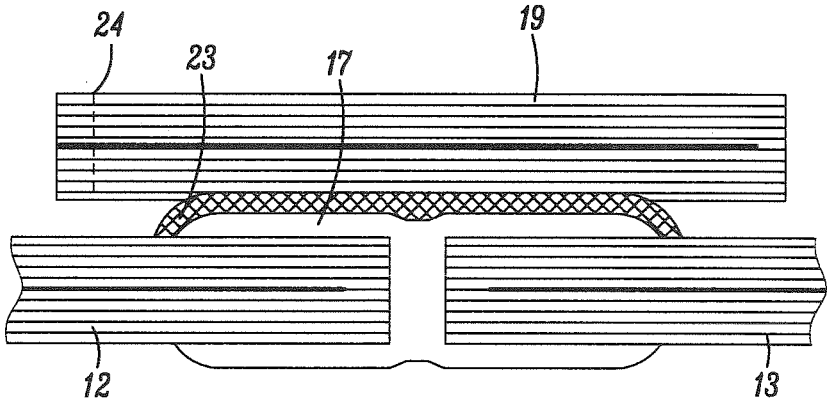

In one preferred embodiment, the disposable garment further comprises a tape of the protective fabric demountably attached to the garment and having a width and length sufficient to fully cover the continuous line of flexible sealing material extending from the neck opening to at least one other opening in the garment. This tape of protective fabric serves as a protection of the continuous line of sealing material. FIG. 4 is a cross-sectional detail of one possible representation of the addition of a tape of a protective fabric 19 fully covering the continuous line of flexible sealing material 17. In this figure, the protective fabric used in the tape is the same material as used for parts 12 and 13, and this is a preferred embodiment. However, the tape could be of a different material as long as the performance is suitable for the expected environment.

The tape of protective fabric is demountably attached to the garment, meaning that the tape is mounted to the garment in such a way that when the continuous line of flexible sealing material is torn, at least a portion of the tape of protective fabric disengages from the exterior of the suit to allow the continuous line of flexible sealing material to be torn without undue effort. As shown in FIG. 4, one method of demountably attaching the tape of protective fabric to the garment is by the use of a double-sided adhesive tape 23. The double-sided adhesive tape is first applied to the tape of protective fabric and then that assembly attached to the garment, fully covering the continuous line of sealing material. As shown in FIG. 4, the double-sided adhesive tape overlaps the sealing material and attaches the tape of protective fabric to the protective fabric used as the outer layer of the garment. It is believed that any type of double-sided adhesive tape that adheres to the surfaces but not so strongly as to tear the fabric (that is, the strength of adherence to the surface is not greater that the strength of the fabric) would be suitable. Also shown in the figure is the useful embodiment wherein tape 19 is constructed by folding the protective fabric upon itself and stitching (24) the ends of the fold such that the outer surface is available for attaching to the double-sided tape. This allows the double-sided tape to be simplified in that is only needs to demountably adhere to only the outer surface of the protective fabric.

The use of the continuous line of flexible sealing material that is capable of being torn allows the disposable protective garment to have no open seams in the front, sides or back during use. The garment can be donned prior to use by pulling the garment over the head like a sweat shirt. After use, the wearer can then then tear the garment along the at least one continuous line of flexible sealing material in the garment to doff or exit the garment.

Figure 5:
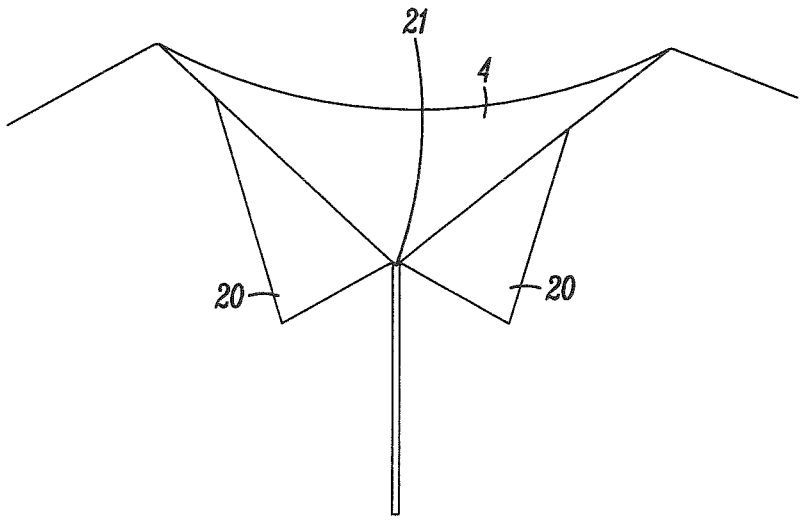
FIGS. 5 & 6 are details of one representation of a collar and neck opening of the disposable protective garment, without and with a first set of neck opening tear tabs for initiating the tear of the continuous line of flexible sealing material.

FIG. 5 is a detail of one representation of a collar and neck opening 4 of the disposable protective garment. In one embodiment, the wearer initiates the tear by simply grasping the collar on both sides 20 and separating the two parts of protective fabric, using the preferred small starting cut or notch 21 located in the continuous line of flexible sealing material. Alternatively, a wearer could simply grasp the shoulder or breast areas of the garment and separate the two parts of protective fabric. However, such methods may not be suitable for all workers; therefore the detail represented in FIG. 6 is a preferred embodiment.

Figure 6:
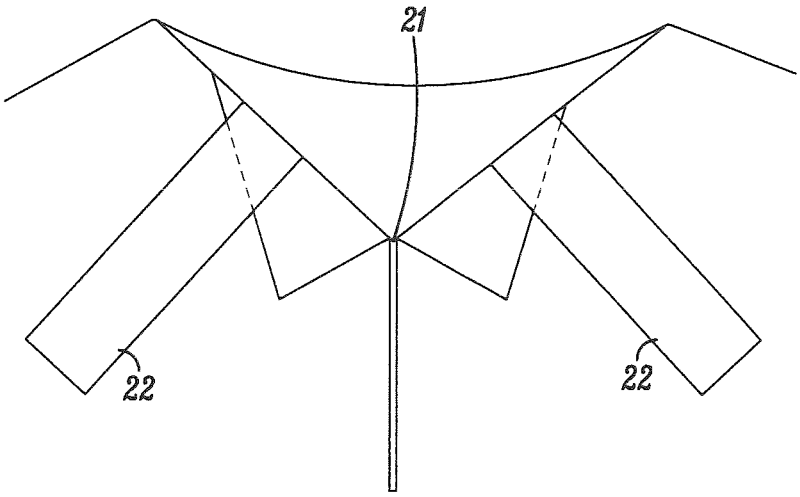

FIG. 6 is a detail of the disposable protective garment further comprising a first set of neck opening tear tabs 22 for initiating the tear of the continuous line of flexible sealing material using the preferred small starting cut or notch 21 located in the continuous line of flexible sealing material. The neck opening tear tabs include at least a first tear tab attached to a first part of the protective fabric and a second tear tab attached to a second part of protective fabric. Each of the tear tabs has a first end and a second end. The first end of each tab is attached to their protective fabric on the interior surface of the garment, preferably by stitching the tab to the fabric or a unitary structure combining the protective fabric and a liner using for example a single needle lockstitch. Each of the first ends of the tabs is attached to the interior surface such that the continuous line of flexible sealing material is positioned between the attachment points of the first and second tabs. In other words, the first ends are attached on either side of the continuous line of flexible sealing material on the interior of the garment. The second end of each tear tab extends through the neck opening over the collar and remains free such that the second ends can be grasped by the wearer and pulled to tear open the continuous line of flexible sealing material. The neck opening tear tabs can be made from many different types of durable woven or nonwoven or webbing materials, as long as they have adequate strength in the use. For example, tear tabs can be made from a fabric like DuPont Tychem® F fabrics, which feature a film-laminated Tyvek® fabric. One useful feature is to make the tear tabs from a fabric having a different color from the protective garment fabric so that the tear tabs can be readily recognized.

The overall length of the disposable protective garment typically extends at least to mid-thigh on the wearer and may extend to the knee. In such instances, it has been found that additional tear tabs are desired. Therefore in one preferred embodiment the disposable protective garment further comprises a set of interior tear tabs for assisting and continuing the tear of the continuous line of flexible sealing material once the tear of the continuous line of flexible sealing material has been initiated.

These interior tear tabs include at least a first tab attached to the first part of protective fabric and a second tab attached to the second part of protective fabric, and the interior tear tabs are positioned between about one-third to two-thirds the distance from the neck opening to at least one other opening in the garment. In other words, if the continuous line of flexible sealing material is vertically disposed in the garment, the interior tear tabs are positioned on either side of the continuous line of flexible sealing material about one-third to two-thirds the distance from the neck opening to torso opening.

Each of the interior tear tabs have a first end and a second end, the first end of each tab being attached to their respective protective fabrics on the interior surface of the garment, the continuous line of flexible sealing material being between attachment points of the first and second tabs.

Figure 7:
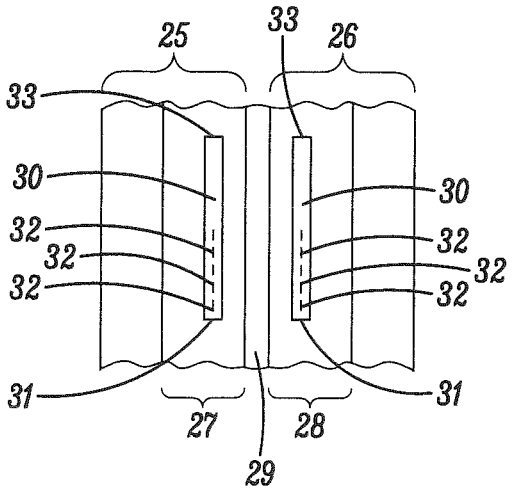
FIG. 7 is a detail of one representation of a view of the interior of the garment, showing the positioning of a set of interior tear tabs for assisting and continuing the tear of the continuous line of flexible sealing material.

FIG. 7 is a detail of one representation of the positioning of a set of interior tear tabs for assisting and continuing the tear of the continuous line of flexible sealing material. The view as shown is of the interior surface of the garment, showing first part 25 of protective fabric and second part 26 of protective fabric. In this embodiment the parts of protective fabric are folded back upon themselves and attached or stitched together (which is not shown for clarity) to form an areas 27 & 28 on which to seal together using a continuous line of flexible sealing material 29. Further, on either side of the continuous line of flexible sealing material are the interior tear tabs 30, each having have a first end 31 that is attached to the first and second parts of protective fabric using single needle lockstitches 32. The second end 33 of each interior tab remains free to be grasped by the wearer and pulled when the interior tear tabs are exposed by the initial tear of the continuous line of flexible sealing material. The interior tear tabs can be made from the same material as the neck opening tear tabs. Also, preferably the interior tear tabs are attached such that the second or free end is closer (than the attached end) to the tear initiation point of the continuous line of flexible sealing material.

In one preferred embodiment, the continuous line of flexible sealing material the disposable protective garment extends from the neck opening to the torso opening. However, in other embodiments, the continuous line of flexible sealing material the disposable protective garment extends from the neck opening to the sleeve opening. Multiple instances of the continuous line of flexible sealing material can be used in a garment if desired and suitable for the expected hazard.

Figure 8:
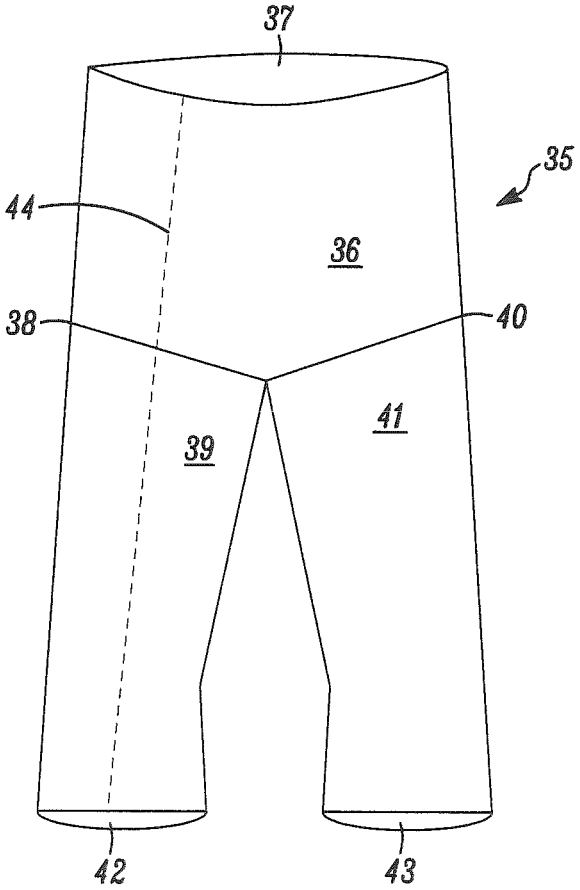
FIG. 8 is an illustration of one representation of a disposable protective garment with the continuous line of sealing material shown extending from the wasteband of the garment down the pants sleeve on the front of the garment.

In another embodiment, one version thereof represented in FIG. 8, the disposable protective garment 35 comprising a protective fabric has a body portion 36 for covering at least a portion of a person's torso when the garment is worn by a person; the body portion having at least one torso opening 37 for donning the garment and a plurality of openings; the plurality including at least a first opening 38 ending in a first pants sleeve 39 for receiving a portion of a person's right leg when the person wears the garment, and a second opening 40 ending in a second pants sleeve 41 for receiving a portion of a person's left leg when the person wears the garment, each of the pants sleeves further having an opening (42 & 43) for a person's ankle and foot; the garment having an interior surface facing a person's body when the person wears the garment and an exterior surface facing a potentially hazardous environment or threat; the garment being provided with at least one continuous line of flexible sealing material extending from the torso opening to at least one pants sleeve opening, the sealing material attaching a first part of the protective fabric to a second part of the protective fabric, the continuous line of sealing material forming a liquid-impervious seal between the first and second parts of protective fabric; wherein the sealing material has a tensile strength less than the tensile strength of the protective fabric and the continuous line of flexible sealing material can be torn open by the wearer for doffing of the garment.

FIG. 8 illustrates one representation of a disposable protective garment 35 with the continuous line of sealing material shown extending from the waistband of the garment down the pants sleeve on the front of the garment, as represented by dotted line 44. If desired, the garment can be provided with at least one continuous line of flexible sealing material extending from the torso opening to at least the first pants sleeve opening and at least one continuous line of flexible sealing material extending from the torso opening to at least the second pants sleeve opening. Further, this garment can have all the appropriate features described for the prior disposable garment, including If desired the pants sleeves can be provided with cinching tapes, such as hook and loop fasteners, for closing the pants sleeves (not shown). Likewise, string ties or other closure options for any of the openings can be employed if desired.

As described herein, the disposable protective garment can further comprise comprising a tape of the protective fabric demountably attached to the garment and having a width and length sufficient to fully cover the continuous line of flexible sealing material extending from the torso opening to at least one pants sleeve opening in the garment.

Any of the embodiments of protective garments described herein can further comprise a lining fabric. In the garment, the lining fabric is preferably positioned between the wearer and any outer protective fabric. The lining can be any suitable fabric comfortable to the skin, but especially useful are woven or nonwoven fabrics. Preferably the lining is a spunlaced or spunbonded nonwoven fabric comprising fibers or filaments made from a synthetic polymer.

The garment preferably comprises a protective apparel fabric. The term "protective apparel fabric" is meant to include a wide variety of protective garment fabrics, barrier fabrics, laminates, and films. The term "protective apparel fabric" also includes nonwoven and/or woven fabrics and laminates of such materials with films or multilayer films. In some embodiments, protective fabric comprises a chemically-resistant outer layer. In some preferred embodiments the protective apparel fabric, and therefore the apparel material, is a multilayer-film-and-nonwoven laminate. In some embodiments the apparel material is a nonwoven that resists penetration by liquids and/or particulates, such as a nonwoven like Tyvek® spunbonded polyethylene. One preferred protective apparel fabric is DuPont Tychem® C fabrics, which feature a coated Tyvek® fabric. These fabrics provide barrier protection against a wide range of inorganic chemical and biological hazards, yet are lightweight and comfortable. Other useful fabrics are DuPont Tychem® F fabrics, which feature a film-laminated Tyvek® fabric. In addition, other useful protective apparel fabrics that protect against a wide variety of threats can be used and include but are not limited to those generally disclosed in U.S. Pat. No. 5,626,947 (Hauer et al.); U.S. Pat. No. 4,855,178 (Langley); U.S. Pat. No. 4,272,851 (Goldstein); U.S. Pat. No. 4,772,510 (McClure); U.S. Pat. No. 5,035,941 (Blackburn); U.S. Pat. No. 4,214,321 (Nuwayser); U.S. Pat. No. 4,920,575 (Bartasis); U.S. Pat. No. 5,162,148 (Boye); U.S. Pat. No. 4,833,010 (Langley).

It is believed the garment features described herein can be applied as part of a Level A, B, C or D protective garment. Level A garments are used in situations that require the highest level of skin, respiratory, and eye protection, and are generally totally encapsulating vapor protective garments. Level B garments are used in situations that require the highest level of respiratory protection but a lesser level of skin protection is needed. Level C garments are used in situations where atmospheric contaminants, liquid splashes, and other direct contact will not adversely affect or be absorbed by any exposed skin. Level D garments are used in situations where contamination is only a nuisance. There may be some instances where combinations of protective apparel rated for A, B, C, or D level may be used together. In some embodiments the garment is part of an encapsulating chemical-resistant suit, in some embodiments it is part of coveralls, or part of any type of shirt or coat or pants or combination garment.

What is claimed is:

1. A disposable protective garment comprising a protective fabric, the disposable protective garment having:

a body portion configured for covering at least a portion of a torso of a person when the disposable protective garment is worn by the person; the body portion having at least one torso opening configured for donning the disposable protective garment and a neck opening configured for receiving a head and neck of the person;

the body portion further having a plurality of openings;

the plurality of openings including at least a first opening ending in a first sleeve configured for receiving a portion of a right arm of the person when the person wears the disposable protective garment, and a second opening ending in a second sleeve configured for receiving a portion of a left arm of the person when the person wears the disposable protective garment, each of the first and second sleeves further having an opening configured for receiving a wrist and hand of the person;

the disposable protective garment having an interior surface configured for facing a body of the person when the person wears the disposable protective garment and an exterior surface;

the disposable protective garment being provided with a front seam closed with at least one continuous line of flexible sealing material extending from the neck opening to at least one other opening in the disposable protective garment, the at least one continuous line of flexible sealing material attaching a first part of the protective fabric to a second part of the protective fabric, the at least one continuous line of sealing material forming a liquid-impervious seal between the first and second parts of protective fabric;

wherein the at least one continuous line of flexible sealing material has a tensile strength less than a tensile strength of the protective fabric and the at least one continuous line of flexible sealing material is configured to be torn by the person to doff the disposable protective garment;

the disposable protective garment further comprising a first set of neck opening tear tabs for initiating a tear of the at least one continuous line of flexible sealing material;

the first set of neck opening tear tabs including at least a first tear tab attached to the first part of protective fabric and a second tear tab attached to the second part of protective fabric;

each neck opening tear tab of the first set of neck opening tear tabs having a first end and a second end, the first end of each neck opening tear tab being attached to their respective protective fabrics on the interior surface of the disposable protective garment, the at least one continuous line of flexible sealing material being between attachment points of the first and second tear tabs;

the second end of each neck opening tear tab extending through the neck opening and remaining free such that the second ends of each neck opening tear tab is configured to be grasped by the person and pulled to tear open the at least one continuous line of flexible sealing material;

the disposable protective garment further comprising a set of interior tear tabs for assisting and continuing the tear of the at least one continuous line of flexible sealing material once the tear of the at least one continuous line of flexible sealing material has been initiated;

the set of interior tear tabs including at least a first interior tear tab attached to the first part of protective fabric and a second interior tear tab attached to the second part of protective fabric;

the set of interior tear tabs positioned at a distance of between one-third to two-thirds from the neck opening to at least one other opening in the disposable protective garment;

each interior tear tab of the set of interior tear tabs having a first end and a second end, the first end of each interior tear tab being attached to their respective protective fabrics on the interior surface of the disposable protective garment, the at least one continuous line of flexible sealing material being between attachment points of the first and second interior tear tabs;

wherein the second end of each interior tear tab remains free to be grasped by the person and pulled when the set of interior tear tabs are exposed by the initial tear of the at least one continuous line of flexible sealing material.

2. The disposable protective garment of claim 1 further comprising a tape of the protective fabric demountably attached to the disposable protective garment and having a width and length sufficient to fully cover the at least one continuous line of flexible sealing material extending from the neck opening to at least one other opening in the disposable protective garment.

3. The disposable protective garment of claim 1 wherein the at least one other opening in the disposable protective garment is the torso opening used for donning the disposable protective garment.

4. The disposable protective garment of claim 1 wherein the at least one other opening in the disposable protective garment is the opening configured for receiving a wrist and hand of the person.

* * * * *